US006725907B2

(12) United States Patent
Sone

(10) Patent No.: US 6,725,907 B2
(45) Date of Patent: Apr. 27, 2004

(54) THERMOSIPHON

(75) Inventor: Kazuya Sone, Niigata-ken (JP)

(73) Assignee: Twinbird Corporation (JP)

( * ) Notice: Subject to any disclaimer, the term of this patent is extended or adjusted under 35 U.S.C. 154(b) by 0 days.

(21) Appl. No.: 10/341,875

(22) Filed: Jan. 14, 2003

(65) Prior Publication Data

US 2003/0136549 A1 Jul. 24, 2003

(30) Foreign Application Priority Data

Jan. 23, 2002 (JP) ..... 2002-014809

(51) Int. Cl.[7] ..... F28D 15/00

(52) U.S. Cl. ..... 165/104.21; 165/104.11; 165/104.14; 165/104.19

(58) Field of Search ..... 165/104.14, 104.21

(56) References Cited

U.S. PATENT DOCUMENTS 4,382,466 A * 5/1983 Shiraishi ..... 165/104.11
4,798,238 A * 1/1989 Ghiraldi ..... 165/32
5,142,872 A * 9/1992 Tipton ..... 62/6
5,190,098 A * 3/1993 Long ..... 165/104.22
5,582,242 A * 12/1996 Hamburgen et al. ... 165/104.21
5,655,598 A * 8/1997 Garriss et al. ..... 165/104.14
5,947,111 A * 9/1999 Neulander et al. ..... 126/351
5,966,957 A * 10/1999 Malhammar et al. ..... 62/259.2
6,442,959 B1 * 9/2002 Sone ..... 62/333
6,477,847 B1 * 11/2002 Bonaquist et al. ..... 62/99
6,539,733 B2 * 4/2003 Sone ..... 62/119
6,588,498 B1 * 7/2003 Reyzin et al. ..... 165/104.33

FOREIGN PATENT DOCUMENTS

JP 2001-33139 A 2/2001

* cited by examiner

*Primary Examiner*—Henry Bennett
*Assistant Examiner*—Nihir B Patel
(74) *Attorney, Agent, or Firm*—Akerman Senterfitt

(57) ABSTRACT

A thermosiphon which can be manufactured easily at low costs, having excellent resistance to pressure, without the circulation of a working fluid being hindered. A condenser 3 includes a condensing section 4 composed of extruded members in which a plurality of fine pores 7 are formed, a branching section 5 provided on an upstream side of the fine pores 7 to supply a gaseous working fluid returned from a gas pipe 12 into each of the fine pores 7, and a collecting section 6 provided on a downstream side of the fine pores 7 to collect the working fluid condensed inside the fine pores 7 and then supply the same into a liquid pipe 9. The gas pipe 12 is connected to an upper portion of the branching section 5 and the liquid pipe 9 is connected to a lower portion of the collecting section 6.

3 Claims, 11 Drawing Sheets

THERMOSIPHON

BACKGROUND OF THE INVENTION

1. Field of the Invention

The present invention relates to a thermosiphon for efficiently transferring heat by taking advantage of phase change in a working fluid.

2. Description of the Related Art

One of Conventional thermosiphons of this kind is disclosed in, for example, Japanese un-examined patent publication No. 2001-33139. The thermosiphon comprises: a condensing section (a condenser) attached to a Stirling refrigerator (a refrigerator); and a circulation path consisting of a liquid line (a liquid pipe), an evaporator section (an evaporator) and a gas line (a gas pipe), said circulation path being connected to said condensing section.

Operating the Stirling refrigerator deprives the condensing section of heat to thereby condense a refrigerant (a working fluid) thereinside, then supplying the refrigerant thus condensed to the evaporator section via the liquid line so as to vaporize the fed refrigerant inside the evaporator section, thereby depriving a surrounding therearound of heat as a vaporizing latent heat, so that the heat around the evaporator section is transferred to the condensing section and further to the Stirling refrigerator by returning the vaporized refrigerant to the condensing section via the gas line.

For the above-mentioned condensing sections, those which are manufactured by machining metal ingots or by drawing metal plates have conventionally been known other than the one in the form of a coiled copper pipe as described in the above-mentioned patent publication. Further, for the above-mentioned evaporator sections, those which are manufactured by roll bond method or the like have been known besides the one in the form of a zigzagged copper pipe described in the above-mentioned publication.

According to the conventional thermosiphons, however, condensers formed by coiling a copper pipe have had a problem that it is difficult to keep such condensers in close contact with the refrigerators. Further, condensers manufactured by machining process or the like have had a problem that a high precision processing is necessary to keep such condensers in close contact with the refrigerators, thus resulting in high manufacturing costs.

On the other hand, evaporators formed of copper pipes have had a problem that as the cooling of the surroundings around the evaporators progresses, condensed working fluids are likely to stay inside the evaporators, thus leading to a possibility that circulation paths are clogged. Whilst evaporators manufactured by the roll bond method have had no problems as long as working fluids such as chlorofluorocarbon (CFC), alternatives to CFC or the like are used, they have had a problem that it eventually is impossible to use such evaporators as they are unable to withstand an inner pressure if other working fluid, such as carbon dioxide is used in line with no-CFC policy.

SUMMARY OF THE INVENTION

Accordingly, it is an object of the present invention to provide a thermosiphon that can be easily manufactured at low manufacturing costs, and at the same time having an excellent pressure withstanding property, by solving the above-mentioned problems.

It is another object of the present invention to provide a thermosiphon in which the circulation of a working fluid is not hindered.

To attain the objects, there is proposed a thermosiphon in accordance with a first aspect of the present invention, comprising: a condenser attached to a refrigerator for condensing a working fluid; a liquid pipe for discharging the working fluid condensed in the condenser; an evaporating pipe for vaporizing the working fluid fed from the liquid pipe in order to deprive an inside of a container of heat; and a gas pipe for returning the working fluid vaporized inside the evaporating pipe to said condenser, wherein said condenser is made up of: a condensing section made of an extruded member where a plurality of fine pores are formed; a branching section provided on an upstream side of the fine pores of the condensing section to supply the gaseous working fluid returned from the gas pipe to each of the fine pores of the condensing section; and a colleting section provided on a downstream side of the fine pores of the condensing section to collect the working fluid condensed in the fine pores of the condensing section and then supply the working fluid into the liquid pipe, and wherein the gas pipe is connected to an upper portion of the branching section while the liquid pipe is connected to an lower portion of the collecting section.

According to the construction of the first aspect of the present invention, the condensing section made of an extruded member is bent to conform to a contour of the refrigerator and is provided at both ends thereof with the branching and collecting sections, so that the condenser is formed. After the gaseous working fluid is introduced from the gas pipe into a plurality of the fine pores of the condensing section through the branching section, the gaseous working fluid is condensed in the fine pores to merge in the collecting section and then it is introduced into the liquid pipe. Further, as the gas pipe is connected to the upper portion of the branching section and the liquid pipe to the lower portion of the collecting section, the working fluid condensed inside the collecting section can be fed out of the liquid pipe and at the same time the working fluid condensed inside the branching section can be fed into the fine pores without flowing back to the gas pipe.

A thermosiphon according to a second aspect of the present invention is the one according to the first aspect, further including a clamping member for bringing the condensing section into close contact with an endothermic portion of the refrigerator, and such clamping member is provided along an outer periphery of the condensing section.

According to the construction of the second aspect of the present invention, the condensing section is allowed to closely contact the endothermic section of the refrigerator.

Further, a thermosiphon according to a third aspect of the present invention comprises: a condenser attached to a refrigerator for condensing a working fluid; a liquid pipe for discharging the working fluid condensed in the condenser; an evaporator for vaporizing the working fluid fed from the liquid pipe in order to deprive an inside of a container of heat; and a gas pipe for returning the working fluid vaporized inside the evaporator to said condenser, wherein said evaporator is made up of: an evaporating section formed of an extruded member, having a plurality of fine pores formed substantially in parallel with one another; an introducing section provided on an upstream side of the fine pores of the evaporating section, said introducing section introducing the liquid working fluid fed from the liquid pipe into the fine pores of the evaporating section; and an exhausting section provided on a downstream side of the evaporating section, said exhausting section collecting the evaporated working fluid in the fine pores of the evaporating section and then supplying the working fluid thus collected into the gas pipe, and wherein said evaporating section is provided along an outer periphery of the container.

According to the construction of the third aspect of the present invention as described above, the evaporating section made of an extruded member is suitably bent while the introducing section and the exhausting section are provided on both ends thereof, so that the evaporator is formed. After the working fluid condensed in the condenser is introduced from the introducing section of the evaporator into the fine pores of the evaporating section via the liquid pipe, the working fluid is evaporated by depriving the surroundings of the evaporator of heat, as vaporizing latent heat inside the fine pores, which is then allowed to merge in the exhausting section and then discharged into the gas pipe. As the evaporating section is provided along the periphery of the container, the container can be efficiently cooled from its peripheral side.

A thermosiphon according to a fourth aspect of the present invention is one in which a plurality of the fine pores of said evaporator are arranged vertically, disposed in an approximately horizontal manner.

According to the construction of the fourth aspect of the present invention, a liquid working fluid is comparatively unlikely to collect in the upper fine pores, so that if the lower fine pores are clogged by the liquid working fluid, a gaseous working fluid can bypass the lower fine pores to flow through the upper fine pores, thus preventing the circulation of the working fluid from being hindered inside the fluid path.

BRIEF DESCRIPTION OF THE DRAWINGS

For more complete understanding of the present invention, reference is now made to the following description taken in conjunction with the accompanying drawings, in which.

DETAILED DESCRIPTION OF THE PREFERRED EMBODIMENTS

Figure 1:
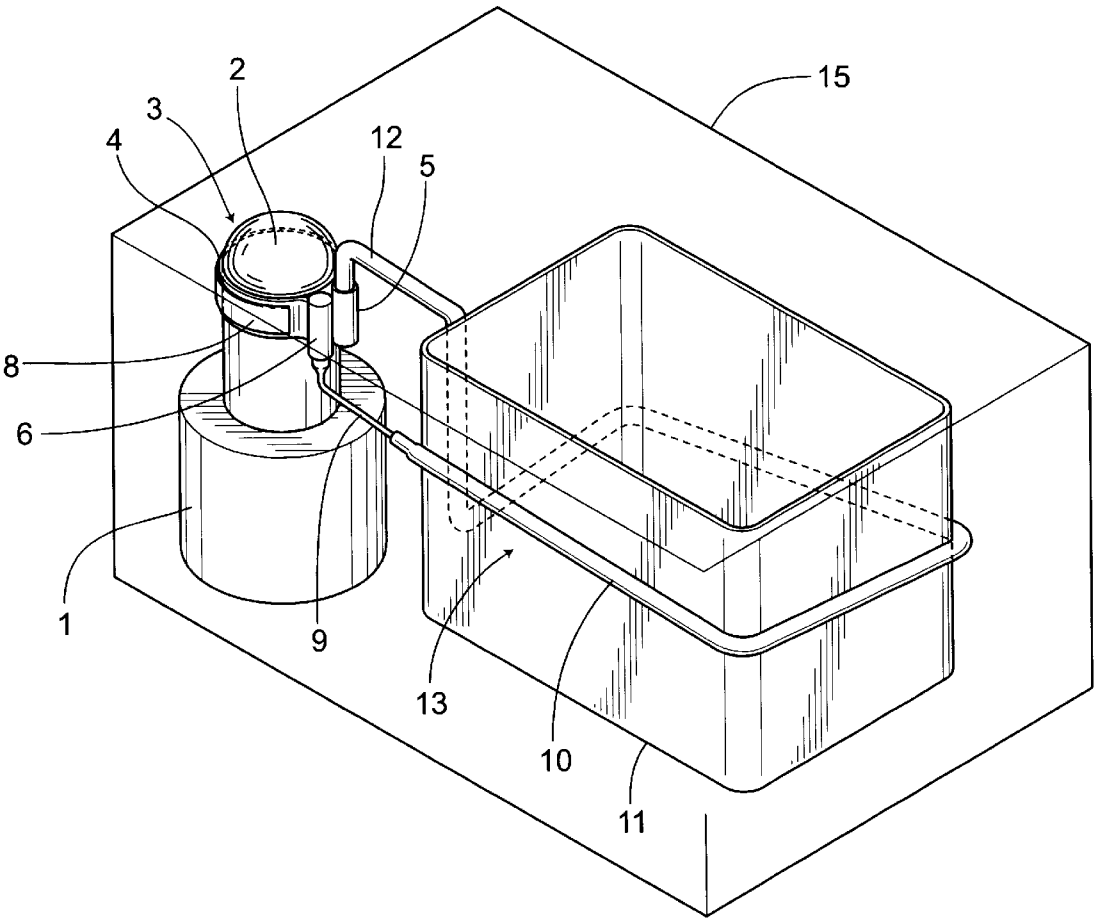
FIG. 1 is a perspective view showing a thermosiphon according to a first embodiment of the present invention.
Figure 2:
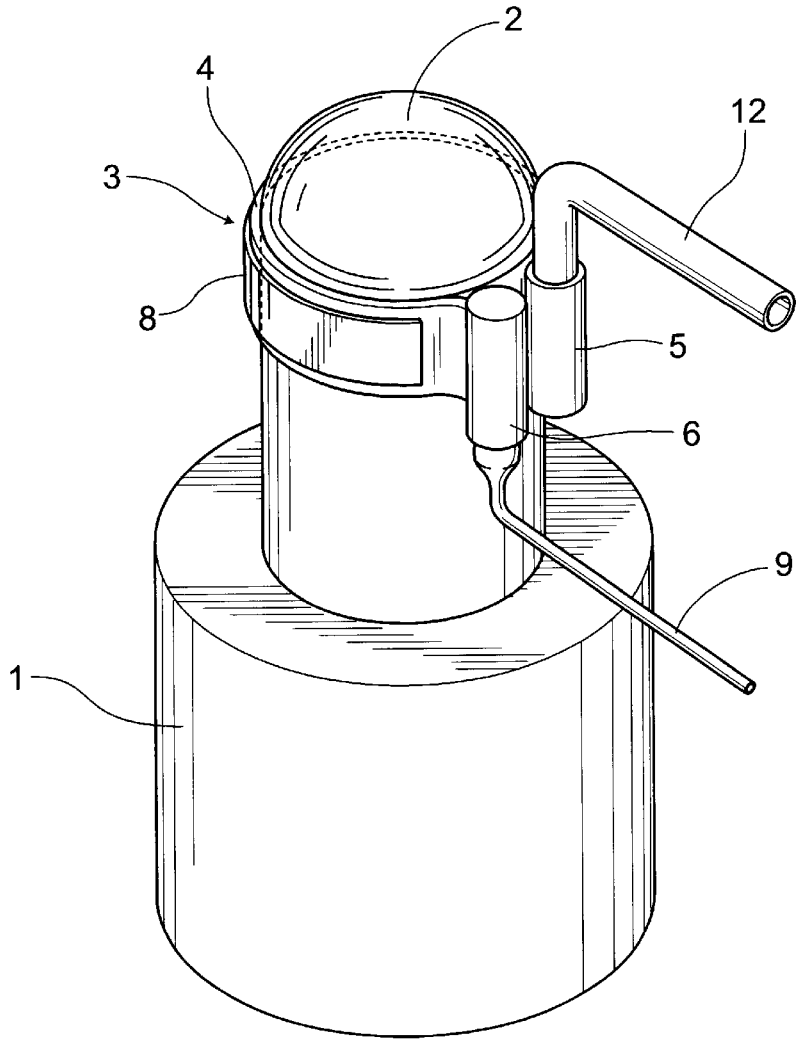
FIG. 2 is an enlarged perspective view showing a principal part of the thermosiphon of the first embodiment.
Figure 3:
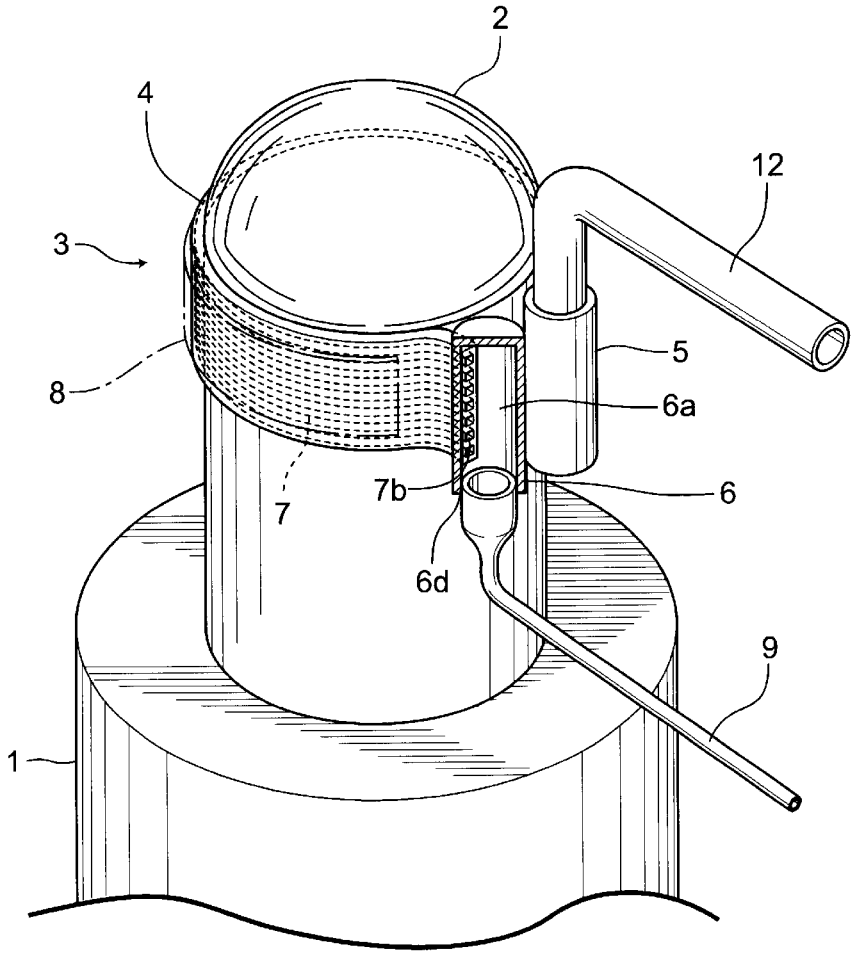
FIG. 3 is a partially cutaway and enlarged perspective view of the principal part of the thermosiphon of the first embodiment.

Hereunder is a description of a first embodiment of the present invention with reference to FIG. 1 through FIG. 6. Numeral 1 denotes a refrigerator, including an endothermic portion 2 with a condenser 3 attached thereto. The condenser 3 comprises: a condensing section 4 which is shaped like a thin plate, formed of an extruded member; a branching section 5 attached to one end 4*a* on an upstream side of the condensing section 4; and a collecting section 6 attached to the other end 4*b* on a downstream side of the condensing section 4. These condensing section 4, branching section 5 and collecting section 6 are each made of aluminum alloy or the like.

Said condensing section 4 is formed with a plurality of fine pores 7 arranged along a surface of the condensing section 4. More specifically, a plurality of the fine pores 7 are arranged in parallel with the longitudinal direction of the condensing section 4 while they are arranged so as to vertically align in the vertical section of the condensing section 4. These fine pores 7 define openings 7*a*, 7*b* at the aforesaid one end 4*a* and the other end 4*b* of the condensing section 4. In the meantime, the condensing section 4 is curved along a contour of the endothermic portion 2 of said refrigerator 1, so that the fine pores 7 may extend substantially horizontally along a periphery of the endothermic portion 2.

Said branching section 5 is formed cylindrical with a hollow space 5*a* thereinside, while the one end 4*a* of said condensing section 4 is firmly and closely connected, by brazing or the like, to an attachment hole 5*c* formed on a side surface 5*b* of the branching section 5 so that the fine pores 7 (or their openings 7*a*) that are open at the one end 4*a* of the condensing section 4 may communicate with the hollow space 5*a*. Said collecting portion 6 also is formed cylindrical with a hollow space 6*a* thereinside, while the other end 4*b* of the condensing section 4 is firmly and closely connected, by brazing or the like, to an attachment hole 6*c* formed on a side face 6*b* of the collecting section 6 so that the fine pores 7 (or their openings 7*b*) that are open at the other end 4*b* of the condensing section 4 may communicate with the hollow space 6*a*.

A connecting hole 5*d* for connecting a hereinafter-described gas pipe 12 thereto is formed in a top portion of said branching section 5, while another connecting hole 6*d* for connecting a hereinafter-described liquid pipe 9 thereto is formed in a bottom portion of said collecting section 6. Further, a clamping member 8 for bringing the condensing section 4 into close contact with the endothermic section 2 of the refrigerator 1 by elastic force is attached along an outside periphery of said condensing section 4. It is to be noted herein that in the condensing section 4 of said condenser 3, a plurality of the fine pores 7 are arranged vertically with the condensing section 4 being attached to the endothermic section 2.

A copper liquid pipe 9 is firmly and closely connected to the connecting hole 6*d* of said collecting portion 6 by brazing or the like. The liquid pipe 9 is formed so as to have an about 1.4 mm inside diameter, with the proximal end thereof being connected to said connecting hole 6*d*, while the distal side thereof being slanted gradually downward. An evaporating pipe 10 which is made of copper and serves as an evaporator is connected to a tip end of the liquid pipe 9. The evaporating pipe 10 is formed so as to have an about 4 mm inside diameter and is attached so that it is slanted gradually downward along an outer surface of a container 11. Further, a gas pipe 12 is integrated with the evaporating pipe 10 at a posterior portion of the evaporating pipe 10. The gas pipe 12 extends substantially vertically upwards along the outer surface of the container 11, and then its end is firmly and closely connected to the connecting hole 5*d* of said branching section 5 by brazing or the like.

Thus, a path 13 of the thermosiphon of the invention is formed by these condenser 3, the liquid pipe 9, the evaporating pipe 10 and the gas pipe 12, while a working fluid such as carbon dioxide or the like (not shown) is filled in the path 13. At this moment, the working fluid is filled so that an internal pressure thereof may be in the order of 6 MPa at the maximum at room temperature. In the meantime, numeral 15 denotes a chassis housing the refrigerator 1, container 11 and path 13 of the thermosiphon of the invention.

Figure 4:
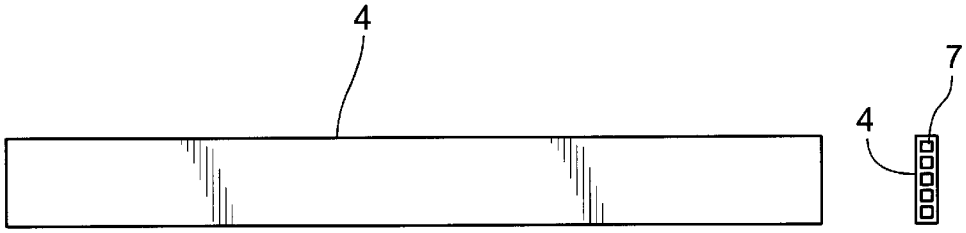
FIG. 4 is an explanatory diagram showing a manufacturing process for manufacturing a condensing section of the thermosiphon of the first embodiment.

Next is a description of a manufacturing process of the aforesaid condenser 3. First, as shown in FIG. 4, the condensing section 4 is formed by extruding an aluminum alloy or the like. As extrusion process itself is well known art, the description thereof is omitted herein. The condensing section 4 is, by the extrusion process, formed like a thin plate in which each of the plural fine pores 7 defines an inside dimension of about one millimeter square, having the open ends 7*a*, 7*b* at both ends thereof, each of said fine pores 7 being formed in parallel with the direction defined by the surface of the condensing section 4.

Figure 5:
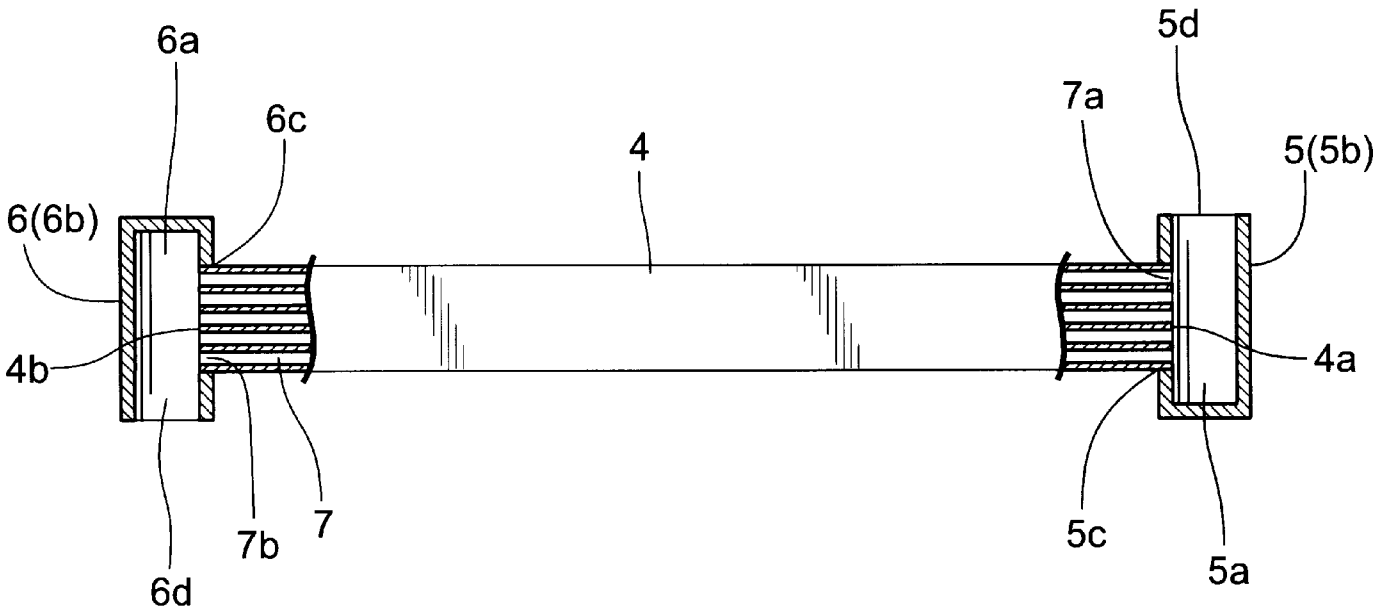
FIG. 5 is another explanatory diagram showing a manufacturing process for manufacturing the condensing section of the thermosiphon of the first embodiment.

Then, one end 4*a* of the condensing section 4 is inserted into an attachment hole 5*c* of the branching section 5 as shown in FIG. 5, so as to communicate the aforesaid open end 7*a* of the fine pores 7 with the hollow space 5*a* of the branching section 5, so that it is firmly and closely connected thereto by brazing or the like. On the other hand, the other end 4*b* of said condensing section 4 is inserted into an attachment hole 6*c* of the collecting portion 6, so as to communicate the aforesaid open end 7*b* of the fine pores 7 with the hollow space 6*a* of the collecting portion 6, so that it is firmly and closely connected thereto by brazing or the like.

Figure 6:
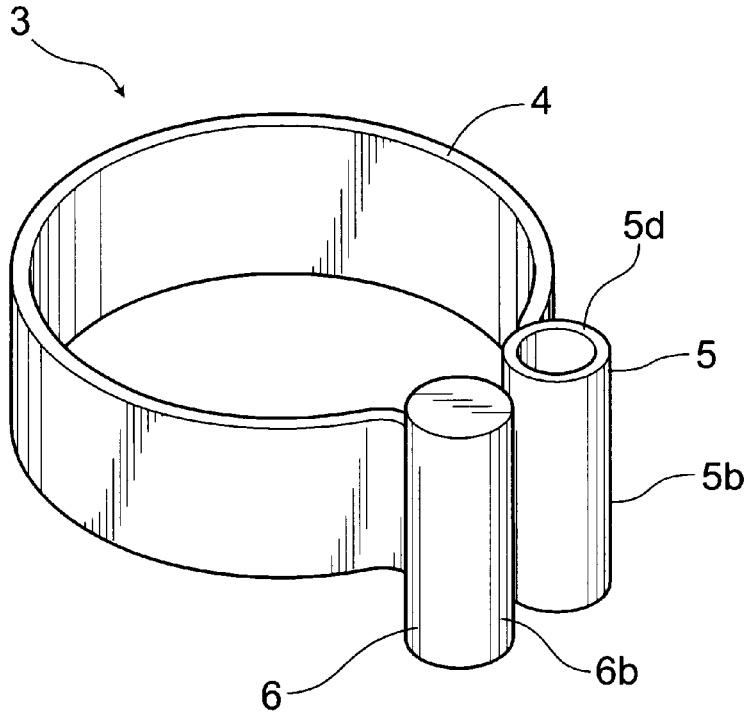
FIG. 6 is a further explanatory diagram showing a manufacturing process for manufacturing the condensing section of the thermosiphon of the first embodiment.
Figure 7:
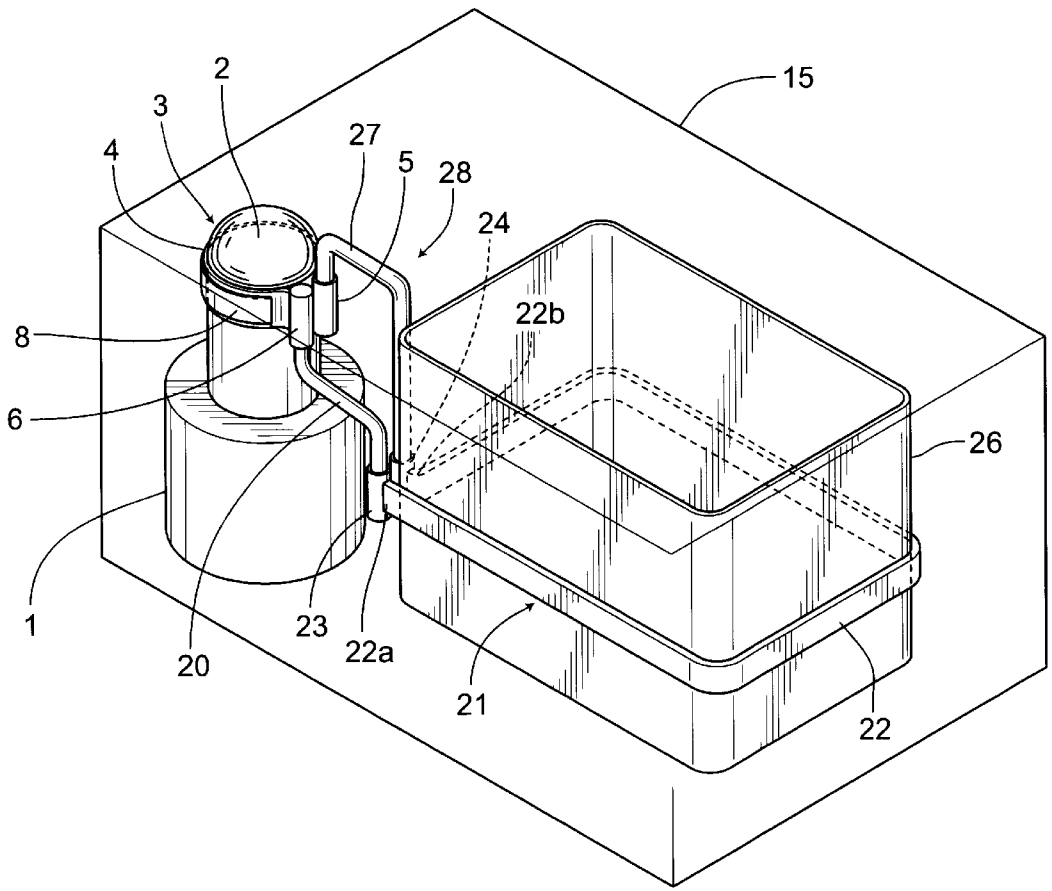
FIG. 7 is a perspective view showing a thermosiphon according to a second embodiment of the present invention.
Figure 8:
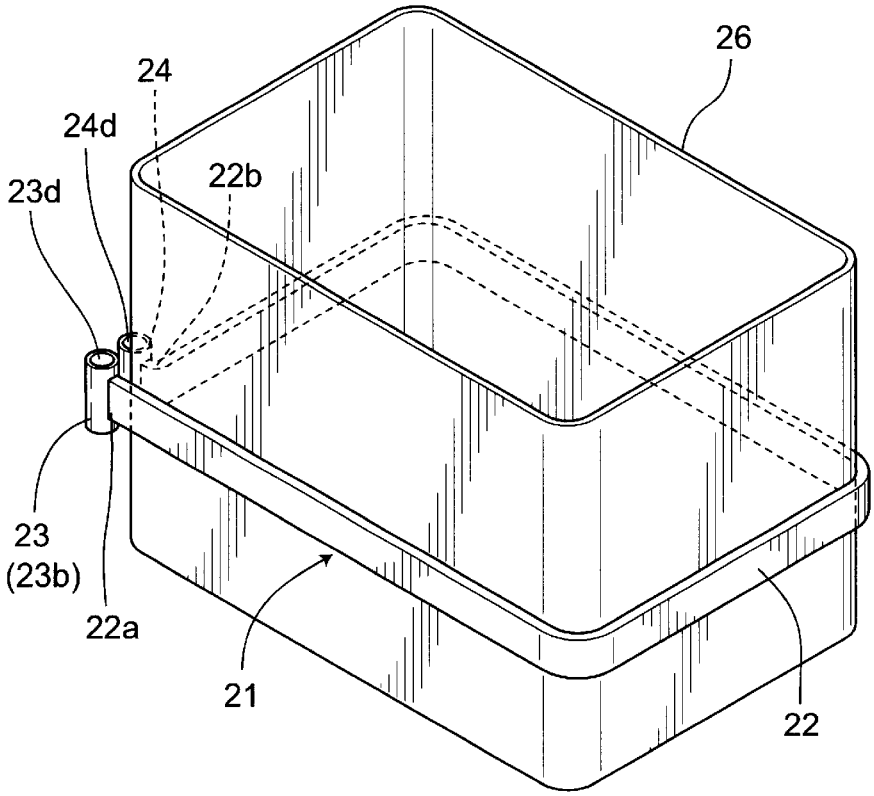
FIG. 8 is an enlarged perspective view showing a principal part of the thermosiphon of the second embodiment.
Figure 9:
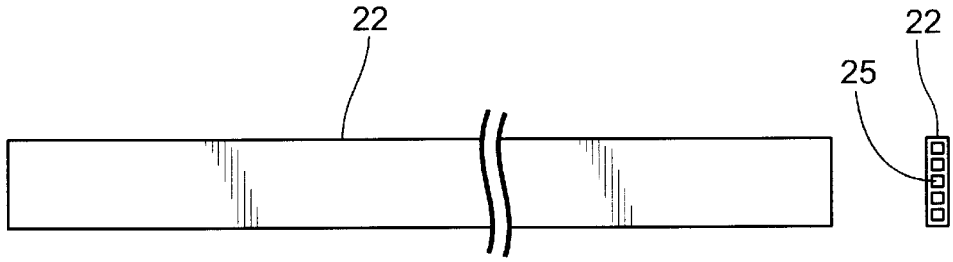
FIG. 9 is an explanatory diagram showing a manufacturing process for manufacturing an evaporating section of the thermosiphon of the second embodiment.

It should be noted that said branching section 5 and collecting section 6 are attached to the condensing section 4 in a manner that the respective connecting holes 5*d*, 6*d* formed therein are directed reversely with respect to each other. Further, as shown in FIG. 6, the condensing section 4 is bent into a shape of letter C so that an inner surface thereof extends along an outer surface of said endothermic section 2, while both ends 4*a*, 4*b* thereof are bent in the mutually opposite directions so as to be approximately orthogonal to the outer surface of the endothermic portion 2 of the refrigerator 1. Thus, the condenser 3 is formed.

Next is a description of the action of the thermosiphon in accordance with the present embodiment. When the refrigerator 1 is actuated to refrigerate the endothermic portion 2, the condenser 3 connected to the endothermic portion 2 is cooled. Then, a gaseous working fluid inside the fine pores 7 of the condenser 3 is condensed. At this moment, as the branching section 5 and the collecting section 6 also are cooled through heat conduction, the working fluid thereinside also is condensed.

For the working fluid in the branching section 5 and the collecting section 6, the working fluid inside the collecting section 6 is fed from the connecting hole 6*d* formed at a lower portion thereof into the liquid pipe 9, while the one inside the branching section 5 is not fed out of the connecting hole 5*d* as the connecting hole 5*d* is formed at an upper side of the branching section 5.

At this moment, pressure inside the hollow space 6*a* of the collecting section 6 is relatively lowered as compared with other sections due to the condensation of the working fluid and the subsequent outflow of such condensed working fluid.

On the other hand, the working fluid inside the evaporating pipe 10 remains gaseous. The gaseous working fluid does not flow back into the liquid pipe 9 of a small inside diameter but flows into the gas pipe 12 of a large inside diameter so that it is fed through the gas pipe 12 into the branching section 5 via the connecting hole 5*d*. At this time, as the pressure is higher in the branching section 5 than in the collecting section 6, the gaseous working fluid fed into the branching section 5 flows from the opening 7*a* of the fine pores 7 to the opening 7*b* together with the working fluid condensed inside the branching section 5, so that the gaseous working fluid is condensed through this process.

As a plurality of the fine pores 7 each of which taking the form of a narrow passage are formed inside the condensing section 4 of said condenser 3, not only can a heat exchanging area be comparatively enlarged, but also can a distance from an inner surface of each fine pore 7 to the center thereof can be reduced, so that the working fluid can be efficiently condensed in the fine pores 7. Further, owing to a plurality of the fine pores 7 of small inner dimensions being formed inside the condensing section 4, pressure-resisting strength of the condensing section 4 can be comparatively enhanced. It should be noted that as the endothermic section 2 and the condenser 3 are contracted due to the lowered temperature upon the actuation of the refrigerator 1, a possible difference in thermal expansion coefficient between the endothermic portion 2 and the condenser 3 is likely to cause a space to be formed between the endothermic portion 2 and the condenser 3. However, as the condenser 3 is elastically pressed to the endothermic portion 2 by the clamping member 8, the condenser 3 can be kept in close contact with the endothermic portion 2.

The working fluid fed out from the connecting hole 6*d* of the collecting section 6 into the liquid pipe 9 is allowed to flow down through the liquid pipe 9 to reach the evaporating pipe 10. Then, the working fluid deprives the container 11 of heat as vaporization heat on its way to the evaporating pipe 10 so that it is evaporated. The working fluid thus evaporated inside the evaporating pipe 10 then returns to the condenser 3 via the connecting hole 5*d* from the gas pipe 12. Thus, the evaporation of the condensed working fluid inside the evaporating pipe 10 enables the cooling of the inside of the container 11 around which the evaporating pipe 10 is wound.

According to the first embodiment of the invention, there is provided a thermosiphon which comprises: the condenser 3 attached to the refrigerator 1 for condensing a working fluid; the liquid pipe 9 for discharging the working fluid condensed in the condenser 3; the evaporating pipe 10 for vaporizing the working fluid fed from the liquid pipe 9 in order to deprive the inside of the container 11 of heat; and the gas pipe 12 for returning the working fluid vaporized inside the evaporating pipe 10 to the above-mentioned condenser 3, wherein said condenser 3 is made up of: the condensing section 4 made of an extruded member where a plurality of the fine pores 7 are formed; the branching section 5 provided on an upstream side of the fine pores 7 of the condensing section 4 to supply the gaseous working fluid returned from the gas pipe 12 to each of the fine pores 7 of the condensing section 4; and the colleting section 6 provided on a downstream side of the fine pores 7 of the condensing section 4 to collect the working fluid condensed in the fine pores 7 of the condensing section 4 and then supply the working fluid into the liquid pipe 9, and wherein the gas pipe 12 is connected to an upper portion of the branching section 5 while the liquid pipe 9 is connected to an lower portion of the collecting section 6.

Consequently, a total surface area of the fine pores 7 becomes large whilst a distance from an inner surface of each fine pore 7 to the center thereof becomes small, so that not only can the working fluid inside the fine pores 7 be efficiently condensed but also can the pressure-resisting strength of the condenser 3 be enhanced. Further, as the gas pipe 12 is connected to the upper portion of the branching section 5 while the liquid pipe 9 to the lower portion of the collecting section 6, respectively, the working fluid is fed from the collecting section 6 to the liquid pipe 9 and then fed from the gas pipe 12 into the branching section 5, thus preventing backflow.

Moreover, as the clamping member 8 for bringing the condensing section 4 into close contact with the endothermic portion 2 of the refrigerator 1 is provided along an outer periphery of the condensing section 4, no space is formed between the endothermic section 2 and the condenser 3 even though the endothermic section 2 has a different thermal expansion coefficient than the condenser 3, so that the condenser 3 can be elastically pressed to the endothermic section 2 by the clamping member 8 to thereby keep the condenser 3 in close contact with the endothermic section 2.

Next is a description of a second embodiment of the present invention with reference to FIG. 7 through FIG. 11. The same reference symbols are used for the same parts as those described in the first embodiment, and the repeated description thereof is omitted.

A copper liquid pipe 20 is firmly and closely connected to the connecting hole 6*d* of the collecting portion 6 by brazing or the like. The liquid pipe 20 is formed so as to have an about 4 mm inside diameter, with the proximal end thereof being substantially vertically connected to said connecting hole 6*d*, while the intermediate portion thereof being slanted gradually downward and the distal end thereof extending substantially vertically downward to connect with an evaporator 21. The evaporator 21 is made up of a tabular evaporating section 22 formed of an extruded member, an introducing section 23 attached to one end 22*a* on an upstream side of the evaporating section 22, and an exhausting section 24 attached to the other end 22*b* on a downstream side of the evaporating section 22. Any of the evaporating section 22, the introducing section 23 and the exhausting section 24 is made of an aluminum alloy or the like.

Said evaporating section 22 is formed with a plurality of fine pores 25 each taking the form of a narrow passage, arranged in parallel with a surface of the evaporating section 22. In other words, a plurality of the fine pores 25 are formed in parallel with a longitudinal direction of the evaporating section 22 so as to be vertically arranged in a line in a cross section of the evaporating section 22. These fine pores 25 have openings 25*a*, 25*b* at the aforesaid one end 22*a* and the other end 22*b* of the evaporating section 22. The evaporating section 22 is attached along a periphery of a container 26 so that the fine pores 25 may extend substantially horizontally.

The introducing section 23 is formed so as to take a hollow cylindrical shape, having a hollow space 23*a* thereinside, while the one end 22*a* of the evaporating section 22 is firmly and closely connected, by brazing or the like, to an attachment hole 23*c* formed on a side surface 23*b* of the introducing section 23 so that the fine pores 25 (or their openings 25*a*) that are open at the one end 22*a* of said evaporating section 22 may communicate with the hollow space 23*a*. Said exhausting section 24 also is formed so as to take a hollow cylindrical shape, having a hollow space 24*a* thereinside, while the other end 22*b* of said evaporating section 22 is firmly and closely connected, by brazing or the like, to an attachment hole 24*c* formed on a side surface 24*b* of the exhausting section 24 so that the fine pores 25 (or their openings 25*b*) that are open at the other end 22*b* of said evaporating section 22 may communicate with the space 24*a*.

In addition, a connecting hole 23*d* connecting to a liquid pipe 20 is formed on a top portion of said introducing section 23 while a connecting hole 24*d* connecting to a copper gas pipe 27 is formed on a top portion of said exhausting section 24. The gas pipe 27 is formed to have an about 4 mm inside diameter, extending nearly vertically along an outer surface of the container 26, with its end portion being firmly and closely connected to the connecting hole 5*d* of the branching section 5 of the condensing section 3 by brazing or the like.

Thus, a path 28 for the thermosiphon is formed by the condenser 3, the liquid pipe 20, the evaporator 21 and the gas pipe 27, while a working fluid such as carbon dioxide (not shown) is filled in the path 28. It should be noted herein that a plurality of the fine pores 25 are arranged vertically in the evaporating section 22 of said evaporator 21 in a state where it is attached to the container 26.

Next is a description of a manufacturing process of the evaporator 21. In the first place, the evaporating section 22 is formed by extruding an aluminum alloy material or the like. The tabular evaporating section 22 is, by this extrusion, formed so that a plurality of the fine pores 25 each of which defines an inside dimension of about one millimeter square, having the open ends 25*a*, 25*b* at both ends thereof, are formed in parallel with the direction defined by the surface of the evaporator 22.

Figure 10:
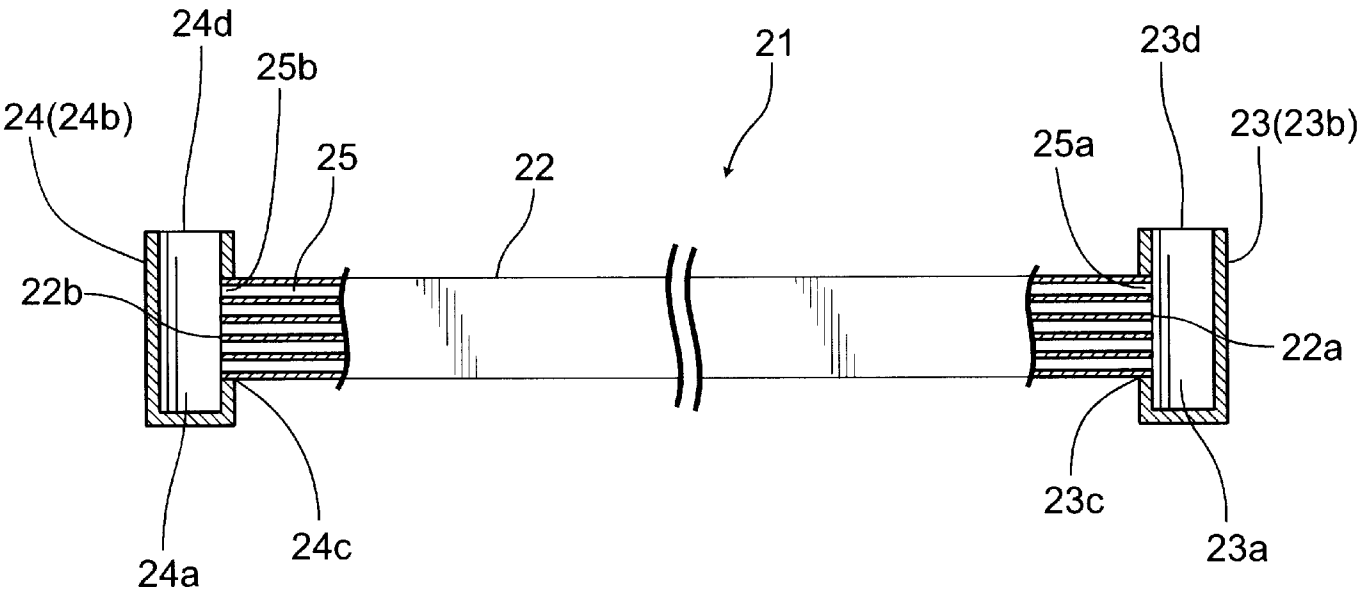
FIG. 10 is another explanatory diagram showing a manufacturing process for manufacturing the evaporating section of the thermosiphon of the second embodiment.

Then, as shown in FIG. 10, the aforesaid one end 22*a* of the evaporating section 22 is inserted into the attachment hole 23*c* of the introducing section 23 so that the one end 25*a* of the fine pores 25 may communicate with the space 23*a* of the introducing section 23, and then firmly and closely connected thereto by brazing or the like. Likewise, the other end 22*b* of said evaporating section 22 is inserted into the attachment hole 24*c* of the exhausting section 24 so that the other end 25*b* of the fine pores 25 may communicate with the space 24*a* of the exhausting section 24, and then firmly and closely connected thereto by brazing or the like.

Figure 11:
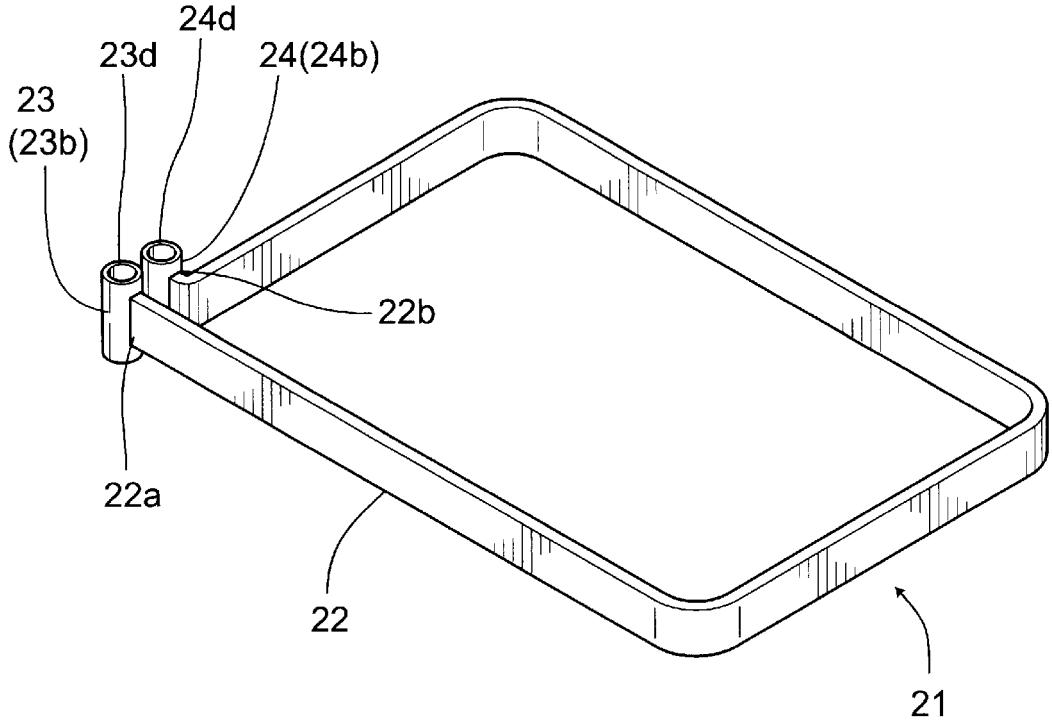
FIG. 11 is a further explanatory diagram showing a manufacturing process for manufacturing the evaporating section of the thermosiphon of the second embodiment.

In a preferred form of the invention, said introducing section 23 and exhausting section 24 are attached to the evaporating section 22 in a manner that the connecting holes 23*d*, 24*d* formed in the respective sections 23, 24 are directed to the same direction. Then, as shown in FIG. 11, the evaporating section 22 is bent along a periphery of the container 26 so that the fine pores 25 extend approximately horizontally. In this way, the evaporator 21 is formed, and the evaporator 21 thus formed is then fixed to the container 26 by brazing or the like so that both the openings of said connecting holes 23*d*, 24*d* face to an upper side.

Next is a description of the behaviors of the thermosiphon according to the present embodiment. When the refrigerator 1 is actuated to cool the endothermic section 2, the working fluid is condensed in the condenser 3 connected to the endothermic portion 2 so that the working fluid thus condensed is fed out from the connecting hole 6*d* of the collecting section 6 into the liquid pipe 20. The liquid working fluid flows down the liquid pipe 20 to reach the space 23*a* of the introducing section 23 via the connecting hole 23*d*, and then flowing through the space 23*a* into a plurality of the fine pores 25 of the evaporating section 22. As these fine pores 25 are arranged vertically as described above, most of the liquefied working fluid flows into the fine pores 25 on a lower side while a relatively little amount of the liquid working fluid flows into those on an upper side.

Accordingly, the working fluid deprives the container 26 of heat as vaporization heat in the fine pores 25 of the evaporating section 22, and then it is evaporated. The working fluid evaporated in the fine pores 25 of the evaporating section 22 then flows from the connecting hole 24*d* of the exhausting section 24 through the gas pipe 27, and then flowing through the connecting hole 5*d* of the branching section 5 to thereby return to the condenser 3 again. This way, the condensed working fluid is evaporated in the fine pores 25 of the evaporating section 22, so that the inside of the container 26 with the evaporator 21 fixed thereto is cooled.

In the meantime, when an ambient temperature around a thermosiphon is low or an average temperature in the whole path 28 drops due to the cooling of the inside of the container 26, a proportion of the working fluid that exists in a liquid state becomes large among the working fluids inside the path 28, so that the liquid working fluid gathers in the lower fine pores 25 inside the evaporator 21, leading to a likelihood that the path 28 extending via the lower fine pores 25 might be clogged. Further, as the cooling of the inside of the container 26 progresses, the amount of heat of which the working fluid can deprive the container 26 as vaporization heat inside the fine pores 25 deceases, so that an evaporation rate per unit of time decreases, so that the amount of the liquid working fluid present in the evaporator 21 increases, thus leading to a likelihood that the liquid working fluid may gather in the lower fine pores 25 to thereby clog the path 28 extending via the lower fine pores 25.

However, as the liquid working fluid is comparatively unlikely to gather in the upper fine pores 25, the gaseous working fluid is allowed to bypass the lower fine pores 25 so as to flow through the upper fine pores 25, whereby the container 26 can be efficiently cooled without a hindrance to the circulation of the working fluid in the path 28. In addition, as a plurality of the fine pores 25 each being of a small inside dimension are formed in the evaporating section 22 of the evaporator 21, not only can a heat exchange area be comparatively enlarged but also can a distance between the inside surface of each fine pore 25 and the center of thereof be comparatively made small, so that the efficient evaporation of the working fluid in the fine pores 25 can be realized. Further, such formation of the fine pores 25 contributes to enhancement of pressure-resisting strength of the evaporating section 22.

According to the second embodiment of the invention, there is provided a thermosiphon which comprises: the condenser 3 attached to the refrigerator 1 for condensing a working fluid; the liquid pipe 9 for discharging the working fluid condensed in the condenser 3; the evaporator 21 for vaporizing the working fluid fed from the liquid pipe 20 in order to deprive the inside of the container 11 of heat; and the gas pipe 27 for returning the working fluid vaporized inside the evaporator 21 to the above-mentioned condenser 3, wherein said evaporator 21 is made up of the evaporating section 22 formed of an extruded member, having a plurality of the fine pores 27 formed substantially in parallel with one another; the introducing section 23 provided on an upstream side of the fine pores 25 of the evaporating section 22, said introducing section 23 introducing the liquid working fluid fed from the liquid pipe 20 into the fine pores 25 of the evaporating section 22; and the exhausting section 24 provided on a downstream side of the evaporating section 22, said exhausting section 24 collecting the evaporated working fluid in the fine pores 25 of the evaporating section 22 and then supplying the working fluid thus collected into the gas pipe 27, and wherein said evaporating section 22 is provided along an outer periphery of the container 26.

Accordingly, a total surface area of the fine pores 7 becomes large whilst a distance from the inner surface of each fine pore 25 to the center thereof becomes small, so that not only can the working fluid inside the fine pores 25 be efficiently evaporated but also can the pressure-resisting strength of the evaporator 21 be enhanced. Further, as the evaporating section 22 is provided along the outer periphery of the container 26, it is possible to efficiently cool the container 26 from the outside.

Moreover, as a plurality of the fine pores 25 of said evaporator 21 are arranged vertically, each extending approximately horizontally, even if the liquid working fluid collects in the lower fine pores 25, circulation of the working fluid inside the path 28 is not hindered due to the gaseous working fluid being allowed to flow from the upper fine pores 25 to the condenser 3 via the exhausting section 24 and the gas pipe 27, thus enabling the efficient cooling of the container 26.

Incidentally, the present invention should not be limited to the above-mentioned embodiments but various modifications are possible within the scope of the invention. For example, the evaporating section may be slanted, like the first embodiment.

What is claimed is:

1. A thermosiphon comprising:

a condenser attached to a refrigerator for condensing a working fluid;

a liquid pipe for discharging the working fluid condensed in the condenser;

an evaporating pipe for vaporizing the working fluid fed from the liquid pipe in order to deprive an inside of a container of heat; and a gas pipe for returning the working fluid vaporized inside the evaporating pipe to said condenser, wherein said condenser is made up of:

a condensing section made of an extruded member where a plurality of fine pores are formed;

a branching section provided on an upstream side of the fine pores of the condensing section to supply the gaseous working fluid returned from the gas pipe to each of the fine pores of the condensing section; and a collecting section provided on a downstream side of the fine pores of the condensing section to collect the working fluid condensed in the fine pores of the condensing section and then supply the working fluid into the liquid pipe, wherein the gas pipe is connected to an upper portion of the branching section while the liquid is connected to an lower portion of the collecting section; and wherein said plurality of fine pores of said condensing section are arranged to extend in parallel along a longitudinal direction of the condensing section, said fine pores being vertically aligned in a cross section of the condensing section.

2. A thermosiphon comprising:

a condenser attached to a refrigerator for condensing a working fluid;

a liquid pipe for discharging the working fluid condensed in the condenser;

an evaporating pipe for vaporizing the working fluid fed from the liquid pipe in order to deprive an inside of a container of heat; and a gas pipe for returning the working fluid vaporized inside the evaporating pipe to said condenser, wherein said condenser is made up of:

a condensing section made of an extruded member where a plurality of fine pores are formed;

a branching section provided on an upstream side of the fine pores of the condensing section to supply the gaseous working fluid returned from the gas pipe to each of the fine pores of the condensing section;

a colleting section provided on a downstream side of the fine pores of the condensing section to collect the working fluid condensed in the fine pores of the condensing section and then supply the working fluid into the liquid pipe, wherein the gas pipe is connected to an upper portion of the branching section while the liquid is connected to an lower portion of the collecting section;

wherein a clamping member for bringing said condensing section into close contact with an endothermic portion of said refrigerator is provided along an outer periphery of said condensing section; and wherein said plurality of fine pores of said condensing section are arranged to extend in parallel along a longitudinal direction of the condensing section, said fine pores being vertically aligned in a cross section of the condensing section.

3. A thermosiphon according to claim 2, wherein said condensing section is bent so that an inner surface thereof may extend along an outer surface of the endothermic portion of said refrigerator.

* * * * *